US008493217B2

(12) United States Patent
Biessman et al.

(10) Patent No.: US 8,493,217 B2
(45) Date of Patent: Jul. 23, 2013

(54) PROGRAMMABLE TOUCH-ACTIVATED SIGNALING DEVICE

(75) Inventors: Wayne H. Biessman, Costa Mesa, CA (US); David L. Ratner, Santa Monica, CA (US); Jeff B. Glickman, Woodinville, WA (US)

(73) Assignee: Magibrands, Inc., Woodinville, WA (US)

( * ) Notice: Subject to any disclaimer, the term of this patent is extended or adjusted under 35 U.S.C. 154(b) by 373 days.

(21) Appl. No.: 13/028,789

(22) Filed: Feb. 16, 2011

(65) Prior Publication Data

US 2011/0199215 A1 Aug. 18, 2011

Related U.S. Application Data

(60) Provisional application No. 61/338,326, filed on Feb. 17, 2010.

(51) Int. Cl.
*G08B 23/00* (2006.01)

(52) U.S. Cl.
USPC ..... 340/573.1; 345/173

(58) Field of Classification Search
USPC ..... 340/573.1, 636.1, 6.1; 345/168, 345/173; 705/15
See application file for complete search history.

(56) References Cited

U.S. PATENT DOCUMENTS

| | | | |
|---|---|---|---|
| 5,926,111 | A | 7/1999 | Davis et al. |
| 6,366,196 | B1 | 4/2002 | Green et al. |
| 6,573,824 | B1 | 6/2003 | Lovegreen et al. |
| 6,782,974 | B2 | 8/2004 | Leifer |
| 6,783,066 | B2 | 8/2004 | Livingston et al. |
| 7,026,916 | B2 | 4/2006 | Alexander |
| 7,171,192 | B2 | 1/2007 | Song et al. |
| 7,242,388 | B2 * | 7/2007 | Lieberman et al. ..... 345/158 |
| 7,369,039 | B1 | 5/2008 | Knutson |
| 7,372,361 | B1 | 5/2008 | Mealing |
| D572,161 | S | 7/2008 | Solheim |

(Continued)

FOREIGN PATENT DOCUMENTS

WO WO 2008/071979 A1 6/2008

OTHER PUBLICATIONS

Bing, Zhu, et al., "Research and design of restaurant service in Wireless Call system," Artificial Intelligence and Education (ICAIE), 2010 International Conference, pp. 437-440 (2010).

(Continued)

*Primary Examiner* — John A Tweel, Jr.
(74) *Attorney, Agent, or Firm* — Nathan O. Greene; Brinks Hofer Gilson & Lione

(57) ABSTRACT

A call-for-service device includes touch targets coupled with a control circuit. A light source is coupled with the control circuit and responsive to selection of the touch targets as controlled by the control circuit, which associates lighting patterns of the light source with respective touch targets to signal to wait staff service requests. The control circuit is programmable through an external connection to set the lighting patterns corresponding to the respective touch targets such that the lighting patterns are customizable for different applications. A selector switch may be coupled with the control circuit and include numerous switch positions, each switch position to control a separate lighting program, each lighting program including a set of lighting patterns, where the control circuit is programmable to associate each lighting program with a different switch position of the selector switch. A base may contain the light source, the touch targets, the control circuit, and the selector switch.

25 Claims, 6 Drawing Sheets

FIG. 1

U.S. PATENT DOCUMENTS

| | | | | |
|---|---|---|---|---|
| 7,415,212 | B2 | 8/2008 | Matsushita et al. | |
| 7,581,442 | B1 * | 9/2009 | Dietz et al. | 73/293 |
| 7,756,947 | B2 | 7/2010 | Yang | |
| 7,791,495 | B1 | 9/2010 | Green et al. | |
| 7,817,058 | B2 | 10/2010 | Waterhouse | |
| 2002/0147647 | A1 | 10/2002 | Ragsdale-Elliott et al. | |
| 2005/0151664 | A1 | 7/2005 | Kolish et al. | |
| 2006/0279415 | A1 | 12/2006 | Solheim | |
| 2009/0076920 | A1 * | 3/2009 | Feldman et al. | 705/15 |
| 2010/0182507 | A1 | 7/2010 | Haggis et al. | |
| 2011/0068942 | A1 * | 3/2011 | Solheim | 340/636.1 |
| 2011/0227853 | A1 * | 9/2011 | Warungu | 345/173 |
| 2012/0200525 | A1 * | 8/2012 | Yamamoto et al. | 345/174 |

OTHER PUBLICATIONS

Shrestha, Natasha, et al., "Demonstration of Visible Light Communications Using RGB LEDs in an Indoor Environment," Electrical Engineering/Electronics Computer Telecommunications and Information Technology (ECTI-CON), 2010 International Conference, 5 pages (2010).

* cited by examiner

PROGRAMMABLE TOUCH-ACTIVATED SIGNALING DEVICE

REFERENCE TO EARLIER FILED APPLICATION

This application claims the benefit under 35 U.S.C. §119 (e) of U.S. Provisional Patent Application No. 61/338,326, filed Feb. 17, 2010, which is incorporated herein, in its entirety, by this reference.

BACKGROUND

1. Technical Field

The disclosed embodiments relate to a call-for-service light, and particularly to a programmable touch-activated signaling device useable to signal for service from wait or service staff or personnel.

2. Related Art

A variety of wait staff signaling devices exist. Many employ radio frequency technology to communicate with the wait staff or with a monitoring device having a display screen in a wait staff area, to alert the wait staff remotely of certain tables that desire service. Other technologies provide customers with the ability to order from their table with varying levels of sophistication. Some wait staff signaling devices are light-source driven and capture the attention of the wait staff with light signals.

BRIEF DESCRIPTION OF THE DRAWINGS

The system may be better understood with reference to the following drawings and description. Non-limiting and non-exhaustive embodiments are described with reference to the following drawings. The components in the drawings are not necessarily to scale, emphasis instead being placed upon illustrating the principles of the present disclosure. In the drawings, like referenced numerals designate corresponding parts throughout the different views.

DETAILED DESCRIPTION

By way of introduction, disclosed is a call-for-service signaling device that includes a number of features for use by both customers and wait staff, yet remains relatively small and unobtrusive as an object on a table or other surface. Reference to wait staff includes any business or setting in which service personnel may employ the call-for-service signaling device. For instance, applications for the signaling device include, but are not limited to, restaurants, bars, private clubs, banquet halls, and the like where foods and/or beverages are served. Other applications may also include those outside the food and beverage industry such as at a service desk, store counter, teaching aid for school, and other applications. Any of those servicing such applications are broadly defined herein as wait staff.

The signaling device may include an emissive light source such as a light bulb, a light emitting diode (LED), or an electroluminescence coating, a printed circuit board (PCB) or other electronic signal conduit, and touch targets responsive to touch selection of options by lighting the light source in any of a number of lighting patterns. The signaling device may include a micro-controller (or other processor, control circuit, or any other analog or digital circuitry) that is programmable to control the lighting patterns in a predetermined way as desired by the wait staff. For instance, the lighting patterns may include specific colors to mean a customer is calling for service, wants a drink re-fill, or may want a check or bill. One of those colors may include white, black light, and/or strobe or other types of light in addition to other colors. Different colors or flashing light, to include flashing colors, may indicate the passage of a certain amount of time so that the wait staff is alerted visually to a status of a service call. In some embodiments, the lighting patterns may be controlled by other analog or digital circuitry that need not be programmed. A decorative cover or the like may be configured to cover the touch targets and include indicia as to what at least some of the touch targets mean.

The signaling device may also include a selector switch (such as a dip switch) that may be coupled with the PCB and includes a number of positions where each position may be associated with a different lighting program. Each lighting program may include multiple lighting patterns that correspond to the touch targets. The wait staff may set the selector switch to place the signaling device in one of various programs depending on its application or setting. For instance, certain holidays may include varied lighting patterns for different events and thus service request needs. A device user may simply change the selector switch setting to a new setting to change the multiple lighting patterns from one program to another. The signaling device may be manufactured with different decorative covers to correspond to the various lighting programs.

Figure 1:
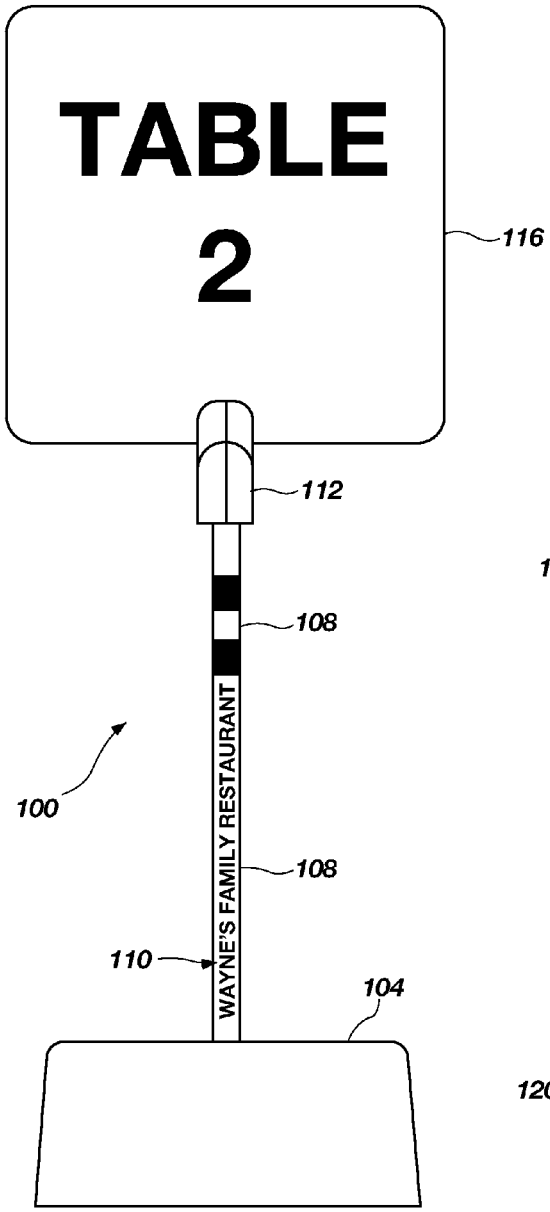
FIG. 1 is a front perspective view of a programmable signaling device as disclosed herein.
Figure 2:
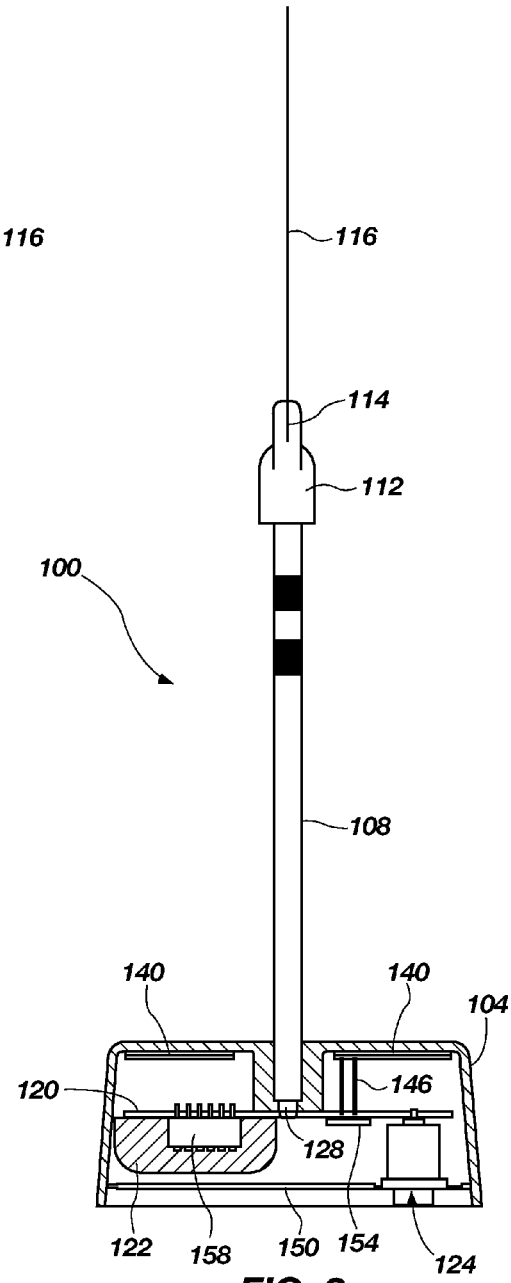
FIG. 2 is a side perspective view of the programmable signaling device of FIG. 1 with a cross-section view of a base of the signaling device.
Figure 5:
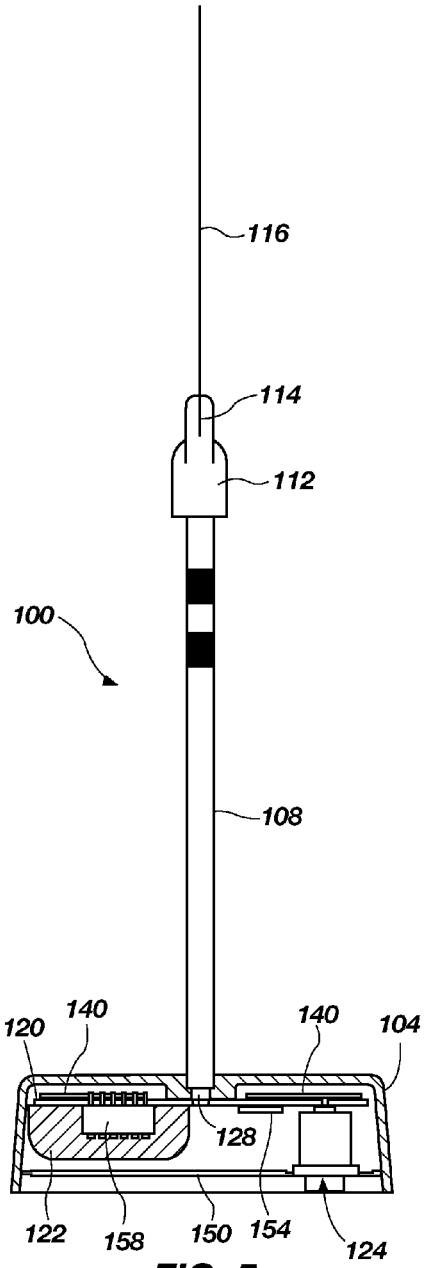
FIG. 5 is a cross-section view of the base of the signaling device of FIG. 2 displaying a different embodiment.

In FIGS. 1 and 2, a call-for-service signaling device 100 may include a base 104 that includes an emissive light source, a substantially translucent shaft 108 or other translucent object such as a dome or other shape, and a clip 112 for holding a placard 116, a specials card, or menu provided by an establishment. The shaft 108 may be made of a clear plastic material such as clear acrylic to allow light to shine through the shaft 108, thus signaling to wait or service staff. The shaft 108 may optionally include etching (or engraving) 110 that may highlight the transmission of light through the etched or engraved portions of the shaft 108. The shaft 108 may be cylindrical or rectangular, although the shaft 108 may also be formed in different shapes such as a heart, for instance, or some other geometric shape. The shaft 108 may be fairly narrow, such as for instance, between 5 and 10 mm across. The shaft 108 may be received by the base 104 such that the shaft remains upright, which will be discussed in more detail later. The shaft 108 may be permanently attached within the base 104 to discourage theft. Alternatively, the signaling device 100 may be manufactured without the shaft 108 and instead use an electroluminescence coating on the base as the emissive light source.

The clip 112 may include a cavity sized to fit onto the distal end of the shaft 108 and form a channel 114 into which a placard 116, a specials card, or a menu provided by an establishment may be inserted. The placard 116 may be permanently attached, such as through adhesive, to the top of the clip 112. The clip 112 may also be made of a clear plastic or other clear material through which light may shine. The placard 116 may optionally be printed or etched with an advertising message or other information such as with table numbers or other identification. The advertising message may be printed on one side and the identifying information may be printed on the other side. The light from the light source located at a proximal end of the shaft may shine through the shaft 108, through the clip 112, and onto the printed or etched placard 116. In the alternative, the clip may be made of a different, opaque material such that light from the light source does not shine onto the placard 116.

The printed placard 116 may be made of a suitably stiff material for printing or etching and such that the placard 116 retains its flatness. The printed matter can be laminated with a clear plastic as desired. The placard is not limited in shape and can be cut or trimmed to any desired shape. The image printed can be of photo quality in a desired graphic. The graphic content of the placard can be custom printed for various needs and occasions. Sequential numbering of graphics in a set can be provided for table or other location identification or designation. The combination of the placard 116 and the clip 112 can be removed and replaced with a different combination including a differently-printed placard 116 for a different occasion or application. The placards 116 can be customized for specific events. For example, some placards 116 could be printed for a wedding reception banquet, e.g., in the shape of two swinging wedding bells with the bride's photo on one of the bells and the groom's photo on the other bell.

The base 104 may contain the circuitry and emissive light source used to signal wait staff according to service requests. With further reference to FIGS. 2 through 10, the base may include a printed circuit board (PCB) 120 or other electronic signal conduit to provide a common bus (320 in FIG. 14) for signal communication. The base 104 may further include a battery holder 122 coupled with the PCB 120 in which to place batteries 123 (FIG. 8) to power the PCB 120 and affiliated circuitry. Herein, the phrase "coupled with" is defined to mean directly connected to or indirectly connected through one or more intermediate components. The intermediate components may include a communications network or a portion thereof. Coupled with may also mean attached to, such as printed or soldered onto a surface such as the PCB 120. The base 104 may further include an on/off power switch 124 coupled with the PCB 120 that is operatively coupled with connections to the batteries of the battery holder 122, to enable turning the signaling device 100 on and off or enable resetting the signaling device 100.

The base 104 may include an emissive light source 128 such as an incandescent light bulb, a light emitting diode (LED), or an electroluminescent coating coupled with or connected to the PCB 120. LEDs are becoming more commonplace and may be preferred as LEDs require less power to operate and last much longer, needing replacement infrequently. The LEDs are of various types, such as tri-color or red-blue-green (RGB), among others. Other types of LEDs are envisioned. The emissive light source 128 may be located proximate to and adjacent the proximal end of the shaft 108 so that light from the light source 128 shines directly through the shaft 108 and becomes diffused into the environment surrounding the signaling device 100. In embodiments excluding the shaft 108, the LED 128 may be positioned near the top of the base 104 and shine through a lens or an electroluminescent coating 128 may be applied to the base 104 and coupled with the PCB 120 to ensure sufficient emission of light.

Figure 3:
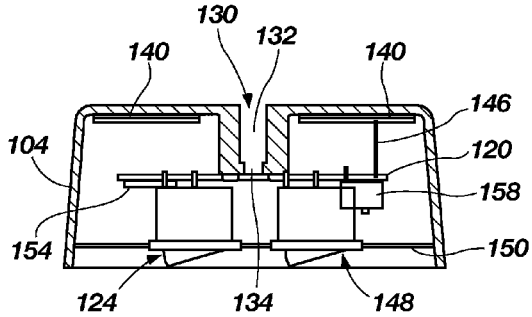
FIG. 3 is a cross-section view of the base of the signaling device of FIG. 2 along a view orthogonal to that of FIG. 2.

In FIG. 3, a cavity 130 may be formed in a top portion of the base 104 for reception of the shaft 108. A top section 132 of the cavity 130 may be cylindrical if the shaft 108 is cylindrical and may be rectangular if the shaft 108 is rectangular. The shaft 108 may be sized just smaller than the top section 132 of the cavity 130 so that the fit is tight and the cavity 130 is able to retain the shaft 108 upright and supportive of the placard 116, card, or menu. A bottom section 134 of the cavity 130 may be sized to receive the light bulb or LED 128 and promote proximity of the light bulb or LED with the proximal end of the shaft 108. Indeed, the light bulb or LED may touch the proximal end of the shaft 108. The tip of the proximal end of the shaft 108 may be polished to enhance the transmission of light from the light bulb or LED 128.

Figure 4:
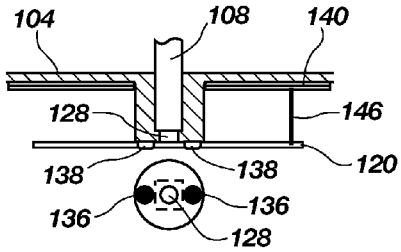
FIG. 4 is an exploded cross-section view of a base end of a translucent shaft of the signaling device of FIGS. 1-3 and a separate view of an emissive light source with locating pins for positioning the light source opposite the base end of the light shaft.

Furthermore, with reference to FIG. 4, a pair of locating pins 136 may be inserted into corresponding holes 138 in the portion of the base 104 that forms the bottom section 134 of the cavity 130 (or into holes 140 in the PCB 120) to properly align the light bulb or LED 128 with the shaft 108. This may be required where the bottom section 134 of the cavity 130 is larger and the bulb or LED fits loosely within the bottom section 134 of the cavity 130. Tolerance fluctuations in dimensions during the manufacturing process may dictate the need for the locating pins 136.

The base 104 may further include a plurality of touch targets 140 located just below a top portion of the base 104 and coupled with the PCB 120 or other electronic signal conduit. The touch targets 140 may be compared to an electrode sensor configured to be sensitive to touch or proximity of touch and may be set for a certain level of sensitivity. For instance, the sensitivity may be set to require actual touch or to require some level of proximity of a human member such as a finger or a hand, which the touch targets 140 sense as a change in capacitance that then registers activation of the tough targets 140. The touch targets 140 may therefore incorporate capacitors or a level of capacitance changeable based on human proximity or touch adapted to provide such a level of touch sensitivity.

Figure 6:
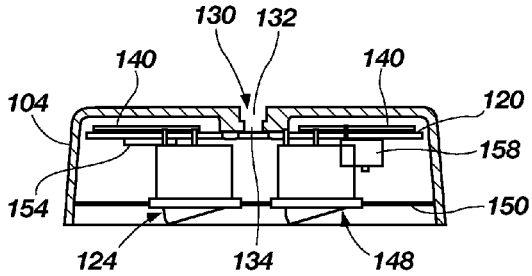
FIG. 6 is a cross-section view of the base of the signaling device of FIG. 5 along a view orthogonal to that of FIG. 5.
Figure 7:
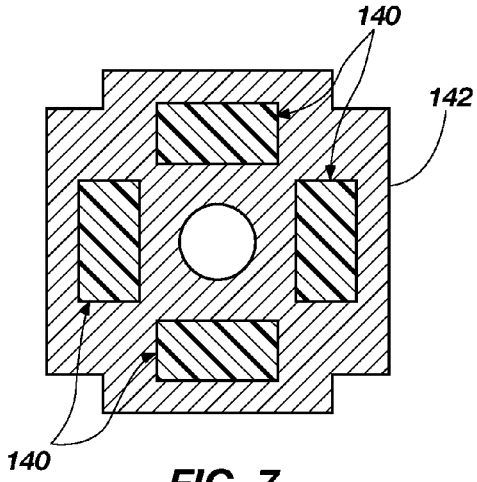
FIG. 7 is a touch screen plate useable in a top portion of the base of the signaling devices of FIGS. 1-6 including at least one portion to function as a touch target that sends a signal responsive to user selection.
Figure 8:
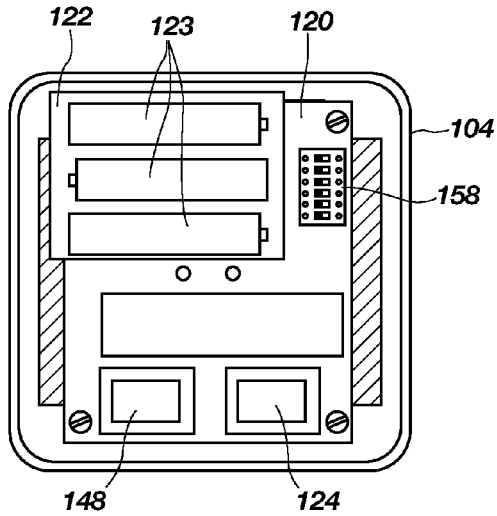
FIG. 8 is a bottom view of the base with a cover removed, showing some of the circuitry within the base of the signaling device of FIGS. 1-6.

A plate 142 such as that shown in FIG. 7 may be used to provide patterns for providing areas underneath the top portion of the base 104 over which indicia 144 (FIG. 9) for the touch targets 140 may be positioned, which will be discussed in more detail later. The patterns may be of any sort of geometrical shape, for instance, including but not limited to square, rectangles, triangles, ovals, circles, and the like, as well as perhaps other odd shapes that are not specifically geometric. One or more electrical connectors 146 may connect the touch targets 140 to the PCB 120 to establish an electrical connection between the touch targets 140 and the electronic circuitry of, or coupled with, the PCB 120. In the base 104 of FIGS. 5 and 6, however, the touch targets 140 may be formed directly on the top of the PCB 120 such as through lithography, chemical vapor deposition, or other method for creating electrodes on a printed circuit board. The electrical connectors 146 may therefore be unnecessary in the embodiments of FIGS. 5 and 6. Also in FIGS. 5 and 6, the cavity 130 may be greatly reduced to ensure the touch targets 140 are sufficiently proximate to the top of the base 104 with which customers and other users will come into contact for service selection.

The touch targets 140 may activate the light bulb 128 or LED 128 to light up the shaft 108 (or to activate the electroluminescence coating) in certain lighting patterns when the touch targets 140 are selected. The touch targets 140 may be associated with one or more lighting patterns. When a touch target 140 is selected by a customer or waiter, for instance, the light bulb or LED may be lit in a certain lighting pattern corresponding to that touch target 140 to indicate a service request or status. The lighting pattern may transition over time to indicate the passage of time and thus whether a customer has been waiting a long time. As an example, when a touch target is selected, the electroluminescence coating, light bulb, or LED 128 may turn green for two minutes, then yellow for one minute, then magenta for one minute, and then may begin flashing magenta thereafter. Different or additional lighting patterns are possible, as this is just one example. Accordingly, by visual indicators, the signaling device 100 can indicate to wait staff approximately how long a service request has been pending, and thus indicate an urgency status as well. This allows the wait staff to prioritize response to those customers who have been waiting the longest.

At any time, a waiter or other member of the wait staff may reset and turn off the light bulb or LED 128 by sending an input into the signaling device. The on/off button 124 may be used for such an input or, in the alternative, the same touch target 140 selected to initiate the service request may be selected to toggle off the lighting patterns and reset the signaling device. When a different area, and thus a different touch target 140, is selected, a different service request such as a "call for check" may be selected which may light the shaft red, for instance. If the call for check button has been lit for longer than five minutes, for instance, it may begin to flash red or orange, for instance, again signaling to wait staff an urgency status of the service request. This service request could be reset as already discussed upon delivering the check to the customer. Furthermore, by a different touch target 140 corresponding to yet a third set of signaling patterns, a bus boy could indicate a table is empty and prepared for seating. A hostess or the like could then reset this status by a touch routine or toggling off the signaling device with the same touch target 140 that the bus boy used. This bus boy touch target 140 or other switch that may be located on a side (not shown) of the signaling device 100 in a hidden location so that regular customers do not use it. Additional or different sets of signaling patterns are envisioned.

The base 104 may also include an intensity switch 148 coupled with the PCB 120 and adapted to adjust the level of intensity of the light from the light bulb or LED 128. For instance, one setting may be full intensity and another setting may set the light intensity to half intensity. In another embodiment, the intensity switch 148 is a variable resistor or potentiometer connected between the batteries 123 and the light bulb or LED 128 that provides for variably setting the light intensity at almost any level. In yet another embodiment, a dimming function may be selectable as a position on a selector switch 158, which will be discussed later, to function in the same way as the intensity switch 148. The base 104 may also include a back cover 150 removable to access the circuitry therein, and thus facilitate replacement or repair of electronic components of the signaling device 100 (FIG. 6).

The base 104 may further include a micro-controller 154 that is programmable to variably set a plurality of lighting patterns corresponding to respective touch targets 140 of the signaling device 100. Herein, "micro-controller" is understood to mean a microprocessor, a processor, or any other programmed analog or digital circuitry. The micro-controller 154 may be coupled with the PCB and an external connection—such as an in-system programmer 354, shown in FIG. 12—to the PCB 120 may provide means through which the micro-controller may be programmed. The micro-controller and the PCB may be broadly referred to as a control circuit. The external connection may include a wired or a wireless connection, such as infrared, a 802.11 wireless LAN standard, or other networking connection. The lighting patterns may be stored in the micro-controller or in memory or other storage (FIG. 14) coupled with the PCB 120. The programmability of the micro-controller 154 allows for easy updating of lighting patterns for different occasions or applications, making it a useful device for many settings.

Furthermore, the base 104 may further include a selector switch 158 such as a dip switch coupled with the PCB 120 and/or with the micro-controller 154 that has a plurality of switch positions. A dip switch with four switches may provide 16 positions and with six positions may provide 64 positions. Each switch position or setting may be programmed to be affiliated with a different lighting program. Each lighting program may include a set of lighting patterns that varies across lighting programs and may be used for different applications, settings, or events. For instance, one position may be for normal use, another for Christmas, another for St. Patrick's Day, etc. A user of the signaling device 100 may set the selector switch 158 to a desired switch position or setting to select a desired program, and thus a desired set of lighting patterns associated with respective touch targets 140.

Figure 14:
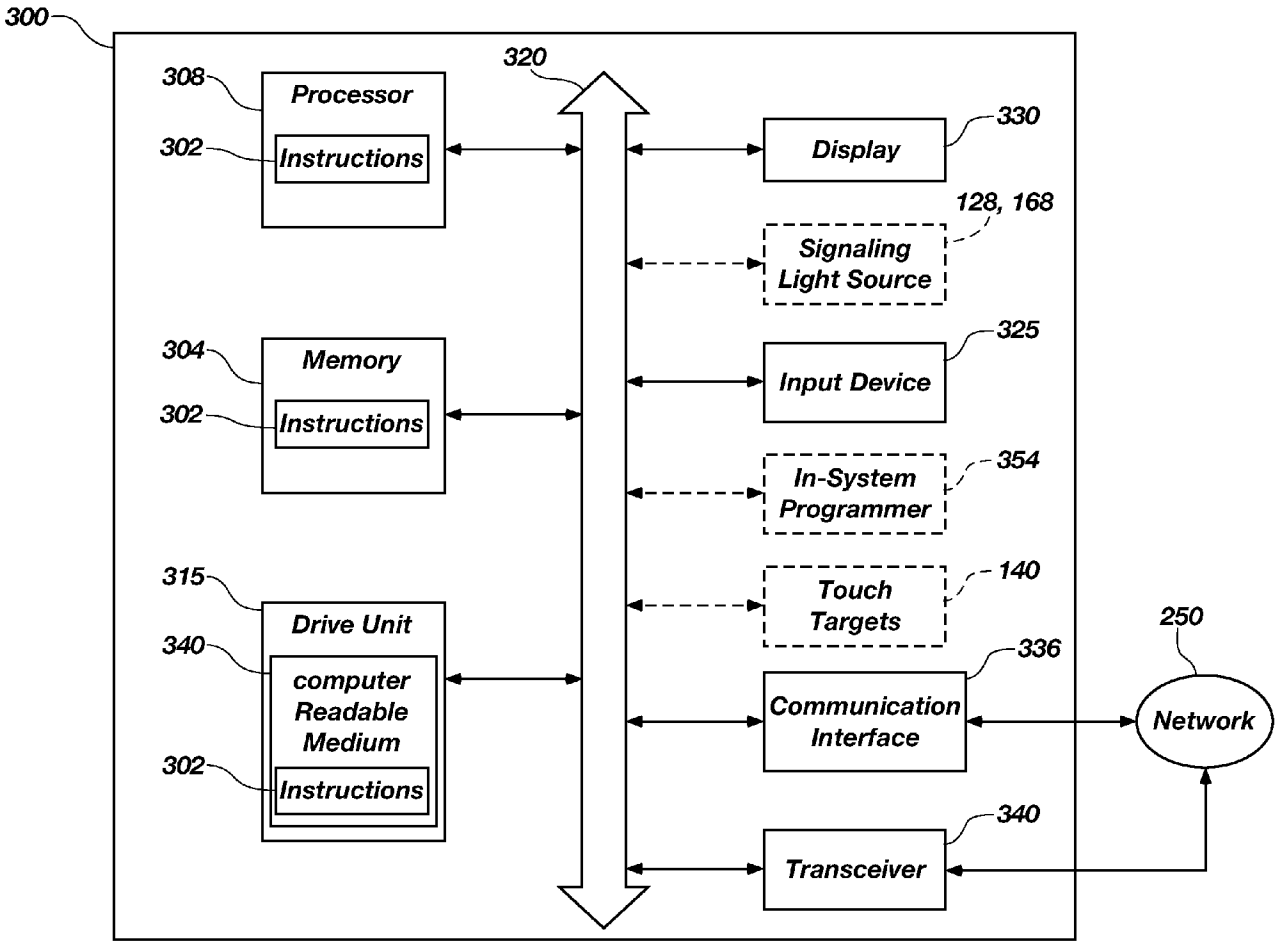
FIG. 14 is a general computer system that may represent any of the computer systems disclosed herein.

In an embodiment, the micro-controller 154 may be programmed with a plurality of lighting programs to associate each lighting program with respective switch positions of the selector switch 158. The association of the lighting programs with respective switch positions may be stored in memory of the micro-controller 154 or in a memory coupled with the PCB 120 (FIG. 14). The micro-controller 154 may therefore be programmed to control the lighting patterns of the touch targets 140 according to the lighting program associated with the selected switch position of the selector switch 158.

The signaling device 100 may also include a decorative base cover 160 (FIGS. 9 and 10) that includes a plurality of indicia 144 discussed earlier. The indicia 144 may be of any geometric shape, including but not limited to, circles, ovals, rectangles, squares, triangles, and perhaps other odd shapes that are not specifically geometric. The indicia 144 may be located over areas of the touch target plate 142 of FIG. 9 such that selection of an indicia 144 causes a detection by a corresponding touch target 140, which signals the light bulb or LED 128 (or electroluminescence) to produce lighting patterns associated with that touch target 140. The indicia 144 may include text lettering, symbols, and/or braille lettering to indicate to customers the meaning of the underlying touch target 140 and expected results from selection of the touch target 140. Again, selection may be executed through bringing a member near a touch target 140 or may require actual touching of the touch target 140.

The decorative base cover 160 may be thermoformed of a thin, non-metallic material such as styrene or a thin, metallic material, either sized to cover the base 104. The decorative base cover 160 may therefore be formed of a shape to match the shape of the base 104. The decorative cover may include or be printed at least in part with an electroluminescence material that may be coupled with the PCB 120 and therefore act as the emissive light source 128 for the signaling device as previously discussed. The decorative base cover 160 may be offered in various materials of different colors, textures, and patterns for different applications or occasions to match the décor of the environment, and thus may be switched out depending on the needs or desires of users of the signaling device 100. Examples of texture can vary from a high gloss color to a flocked texture in the desired color. Simulated wood or stone, advertising message and other graphics can be printed on the decorative base cover 160. The decorative base cover 160 can also be made from translucent styrene or other clear materials, which could allow for printed cards to be slipped between the base and the clear decorative cover for the purpose of providing information such as instructions, notices, advertising messages and the like.

Figure 11:
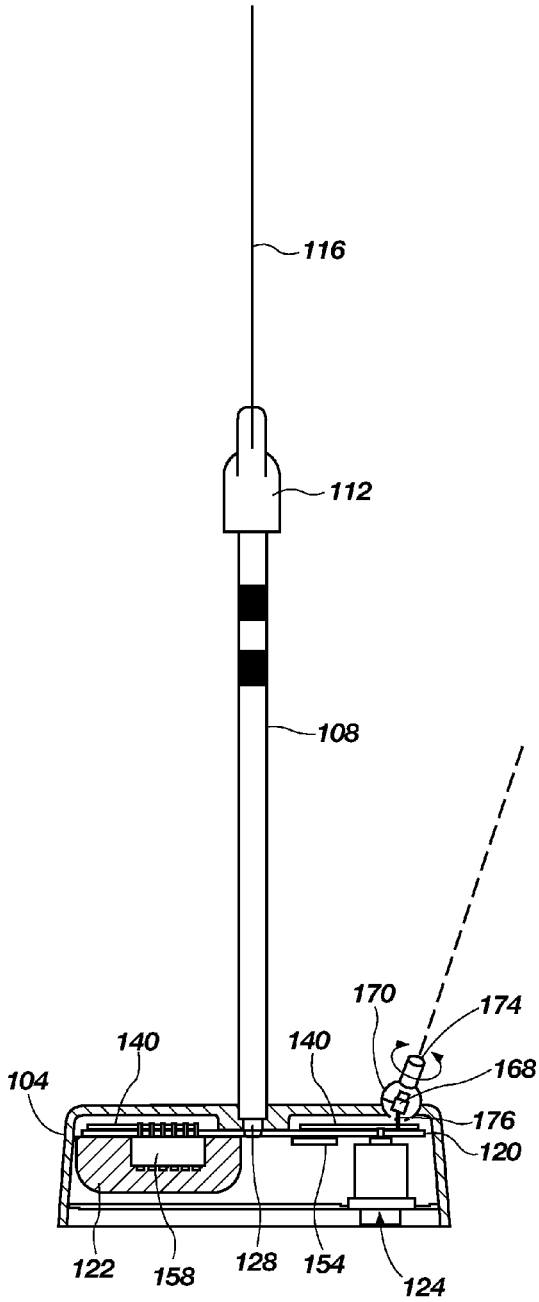
FIG. 11 is a cross-section view of the base of the signaling device of FIGS. 5-6 displaying an additional light positionable within a pivotal housing that includes a lens for diffusing the light onto a nearby surface.
Figure 12:
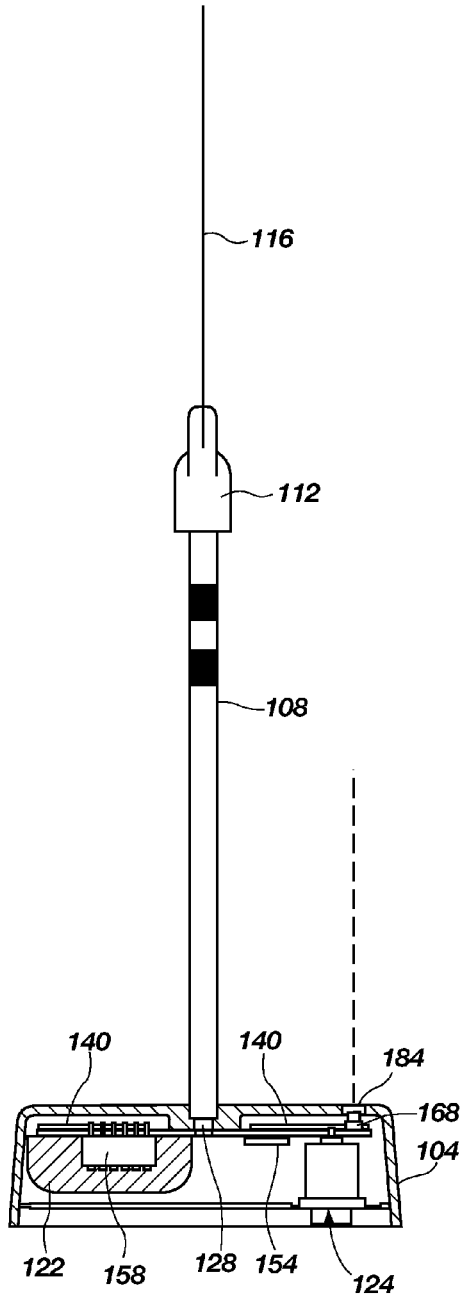
FIG. 12 is a cross-section view of the base of the signaling device of FIGS. 5-6 displaying a lens integrated within a top portion of the base through which light may be diffused onto a nearby wall or ceiling.

In FIGS. 11 and 12, an additional embodiment adds at least a second emissive light source such as another light bulb 168 or LED 168 that is projected onto a nearby surface, to signal to wait staff a service request or status when the shaft 108 is not visible due to an intervening obstacle such as a high back of a booth, a half wall, or the like. This additional light bulb or LED 168 may also be coupled with the PCB 120.

Figure 9:
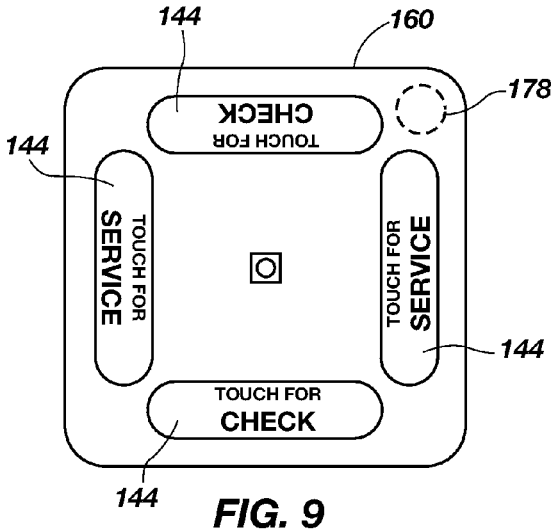
FIG. 9 is a top view of a decorative cover sized to cover the base of the signaling device of FIGS. 1-6 including indicia corresponding to touch targets formed by the touch screen plate of FIG. 7.
Figure 10:
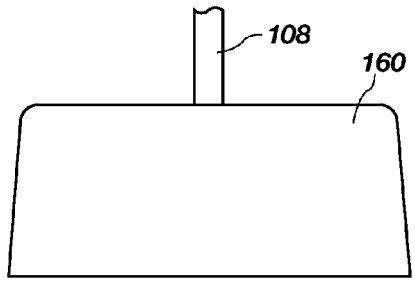
FIG. 10 is a perspective view of the decorative cover of FIG. 9.

In the case of FIG. 11, the light bulb or LED 168 may be positioned within a pivotal housing 170 including a lens 174 to diffuse the light and project the light onto any nearby surface such as a ceiling, wall, or on the side of a piece of furniture. Any other structure may be used to make the lens 174 pivotal and thus the specific housing 170 of FIG. 11 is non-limiting. An electrical connector 176 may connect the light bulb or LED 168 to the PCB 120. The light bulb or LED 168 may also be connected to or coupled with the light bulb or LED 128—the one at the proximal end of the shaft 108—such that they are illuminated at the same time. The pivotal housing 170 may be positioned anywhere in the top portion of the base 104 but preferably in a location void of the touch targets 140. For instance, an aperture 178 in FIG. 9 shows a location on the decorative cover 160 that corresponds to a location on the base 104 through which the pivotal housing 170 may protrude.

In the case of FIG. 12, the light bulb or LED 168 may be connected to the PCB 120 directly and pointed in a generally vertical direction. A lens 184 may then be integrated laterally within the top portion of the base 104 through which light from the light bulb or LED 168 may be diffused and projected on a nearby ceiling or wall. Note that while the light bulb or LED 168 of FIG. 12 is pointing straight up, it could be positioned at an angle and the lens 184 positioned such as to capture and direct the light as just discussed wherein the light is project onto a side surface such as a booth or wall. With sufficient narrowness of the beam of light emanating from the lens 174 or 184, the light beam may retain its strength and project a sufficiently strong light signal onto a nearby surface generally above the signaling device 100. The lens 174 or 184 may be sized to be at least about two times the diameter of the light bulb or LED 168 or otherwise sufficient for projection of the light beam. The light beam may be oriented such that wait or service staff could easily see the projection of the light beam on the nearby surface even when the shaft 108 is hidden or obscured from view due to an intervening obstacle.

Figure 13:
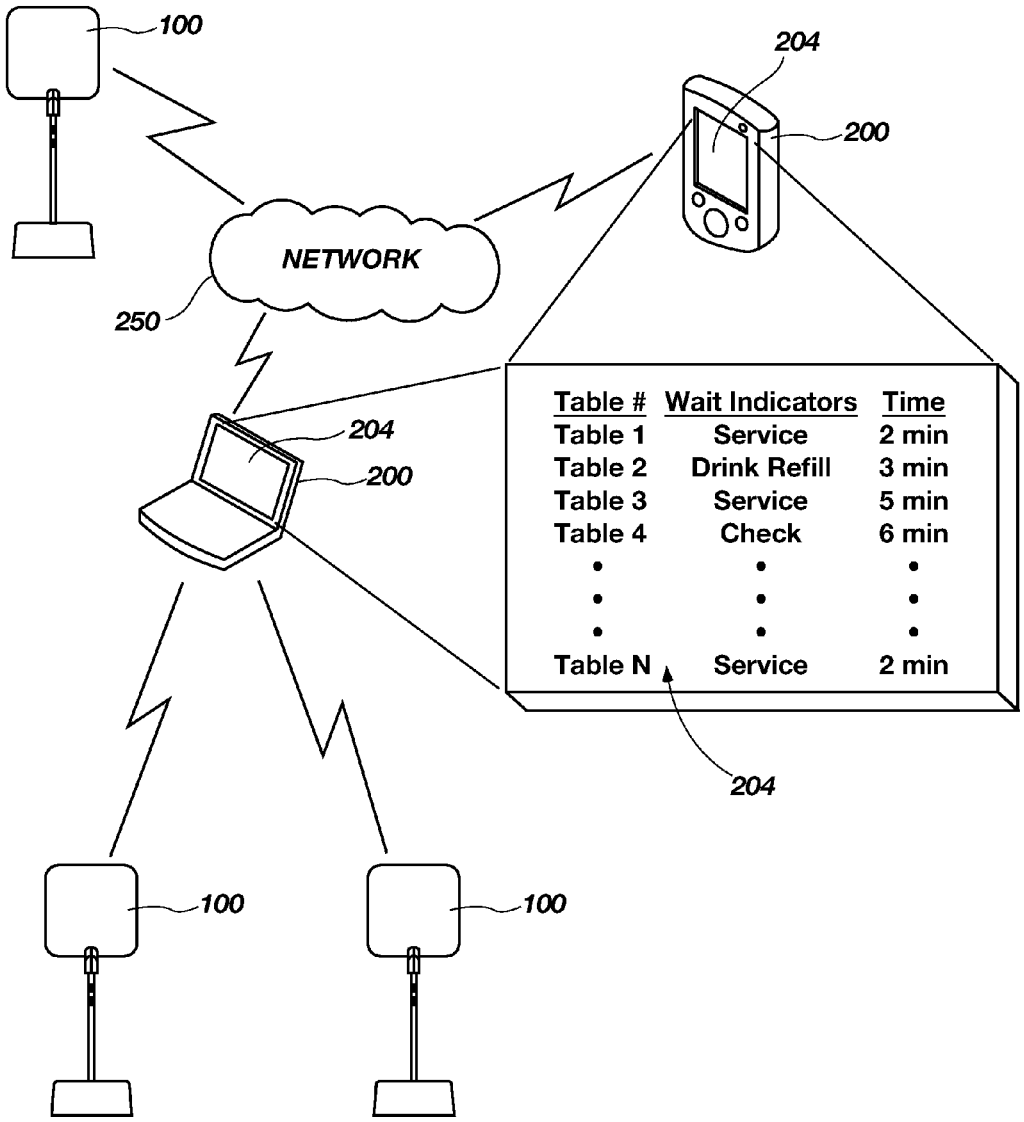
FIG. 13 is a diagram of multiple signaling devices and a remote device for tracking the status of the signaling devices of FIGS. 1-12.

In FIG. 13, a number of signaling devices 100 may communicate wirelessly, for instance through radio frequency (RF), optical communication, or other wireless electronic signals to a remote device 200 used for monitoring and interaction with the signaling devices 100. The signaling devices 100 and remote devices 200 may therefore include receivers, transmitters, or transceivers (FIG. 14) coupled with the PCB 120 that communicate service requests and associated statuses to a remote device 200 and that may be reset by the remote device 200. The remote device 200 may be a computer terminal in a server room, a kitchen, or a service desk which may display the service requests/statuses on a central display board of some kind, e.g., on a display screen 204. The remote device 200 may also include a personal digital assistant (PDA), smart phone, or tablet-type device having a screen 204 that persons on the wait staff can carry. The signaling devices 100 may communicate through a network 250, which may be any kind of local area (LAN) network as detailed later, which may connect to a wide area network (WAN) or to the Internet and thus communicate remotely.

The electronic signals from the signaling devices 100 may duplicate the service requests and associated statuses communicated by the lighting patterns. In the display screen 204 of FIG. 13, the service requests may be listed by table number and include a wait indicator and an approximate time period the wait indicator has been illuminated. Accordingly, the list may include the service requests and their associated statuses in terms of how long customers have been waiting.

The remote devices 200 may also send updates to the programs of lighting patterns stored on the signaling devices 100, which may be adapted to receive such updates wirelessly and automatically adjust programming of respective signaling devices 100 accordingly. The signaling devices may store in memory the new lighting patterns in the updated lighting programs. The signaling devices 100 may also be configured to receive actions with respect to the lighting patterns, including the ability to be turned off and/or reset by wait staff from the remote devices 200. The remote devices 200 may also be able to initiate a new lighting pattern to indicate to the customer that their request has been received and that appropriate action is being taken by the wait staff. A specific radio or wireless identifier may be assigned to each signaling device so that the remote devices 200 may be able to discriminate between them. Alternatively or in addition, the signaling devices may each operate on a different frequency or band so that they do not interfere with each other.

In an alternative embodiment (not shown), the remote devices 200 may include an array of lights or LEDs corresponding to and numbered with individual tables or customer positions. The signaling devices 100 may communicate a duplicate status wirelessly as has been initiated by a customer by selection of the touch targets 140. The status received wirelessly may initiate the same lighting pattern on the light bulb or LED corresponding to the table or position from which the remote device 200 received the wireless status. As mentioned previously, the lighting patterns may be turned off and/or reset by wait staff remotely from the remote device 200.

This centralization of lighting pattern service requests and statuses may facilitate wait staff in their efforts to prioritize their efforts to those that have been waiting the longest, or to those who are waiting for checks especially when there may be a long line of people waiting to be seated. A hostess may have a remote device 200 on her person or at her location at the front of an establishment as a way to track tables that may soon become available to plan where to sit customers and how long they may have to wait.

FIG. 14 illustrates a general computer system 300, which may represent the signaling devices 100, the remote devices 200, or any other computing devices referenced herein. Accordingly, the computer system 300 may include one or more emissive, signaling light sources such as light bulbs or light emitting devices (LEDs) 128 and/or 168. The computer system 300 may include an ordered listing of a set of instructions 302 that may be executed to cause the computer system 300 to perform any one or more of the methods or computer-based functions disclosed herein. The computer system 300 may operate as a stand-alone device or may be connected, e.g., using the network 250, to other computer systems or peripheral devices.

In a networked deployment, the computer system 300 may operate in the capacity of a server or as a client-user computer in a server-client user network environment, or as a peer computer system in a peer-to-peer (or distributed) network environment. The computer system 300 may also be implemented as or incorporated into various devices, such as a personal computer or a mobile computing device capable of executing a set of instructions 302 that specify actions to be taken by that machine, including and not limited to, accessing the Internet or Web through any form of browser. Further, each of the systems described may include any collection of sub-systems that individually or jointly execute a set, or multiple sets, of instructions to perform one or more computer functions.

The computer system 300 may include a memory 304 on a bus 320 such as the printed circuit board (PCB) 120 for communicating information. Code operable to cause the computer system to perform any of the acts or operations described herein may be stored in the memory 304. The memory 304 may be a random-access memory, read-only memory, programmable memory, hard disk drive or any other type of volatile or non-volatile memory or storage device.

The computer system 300 may include a processor 308, such as a central processing unit (CPU) and/or a graphics processing unit (GPU) and/or the micro-controller 154. The processor 308 may include one or more general processors, digital signal processors, application specific integrated circuits, field programmable gate arrays, digital circuits, optical circuits, analog circuits, combinations thereof, or other now known or later-developed devices for analyzing and processing data. The processor 308 may implement the set of instructions 302 or other software program, such as manually-programmed or computer-generated code for implementing logical functions. The logical function or any system element described may, among other functions, process and/or convert an analog data source such as an analog electrical, optical, audio, or video signal, or a combination thereof, to a digital data source for audio-visual purposes or other digital processing purposes such as for compatibility for computer processing.

The computer system 300 may also include a disk or optical drive unit 315. The disk drive unit 315 may include a computer-readable medium 340 in which one or more sets of instructions 302, e.g., software, can be embedded. Further, the instructions 302 may perform one or more of the operations as described herein. The instructions 302 may reside completely, or at least partially, within the memory 304 and/or within the processor 308 during execution by the computer system 300.

The memory 304 and the processor 308 also may include computer-readable media as discussed above. A "computer-readable medium," "computer-readable storage medium," "machine readable medium," "propagated-signal medium," and/or "signal-bearing medium" may include any device that includes, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium.

Additionally, the computer system 300 may include an input device 325, such as a keyboard or mouse, configured for a user to interact with any of the components of system 300. If the computer system 300 is the signaling device 100, the input device 325 may include the touch targets 140 and an in-circuit programmer 354 to program the signaling device 100. The computer system 300 may further include a display 330, such as a liquid crystal display (LCD), a cathode ray tube (CRT), or any other display suitable for conveying information. The display 330 may act as an interface for the user to see the functioning of the processor 308, or specifically as an interface with the software stored in the memory 304 or the drive unit 315.

The computer system 300 may include a communication interface 336 or a transceiver 340 that enables communications via the communications network 250. The network 250 may include wired networks, wireless networks, or combinations thereof. The communication interface 336 network may enable communications via any number of communication standards, such as 802.11, 802.17, 802.20, WiMax, cellular telephone standards, or other communication standards. The transceiver 340 may be a transmitter or a transceiver or both and may enable communications via any number of additional communication standards such as radio frequency (RF), optical, or other communication standards.

Accordingly, the system may be realized in hardware, software, or a combination of hardware and software. The system may be realized in a centralized fashion in at least one computer system or in a distributed fashion where different elements are spread across several interconnected computer systems. Any kind of computer system or other apparatus adapted for carrying out the functions described herein is suited. A typical combination of hardware and software may be a general-purpose computer system with a computer program that, when being loaded and executed, controls the computer system such that it carries out the functions described herein. Such a programmed computer may be considered a special-purpose computer.

The system may also be embedded in a computer program product, which includes all the features enabling the implementation of the operations described herein and which, when loaded in a computer system, is able to carry out these operations. Computer program in the present context means any expression, in any language, code or notation, of a set of instructions intended to cause a system having an information processing capability to perform a particular function, either directly or after either or both of the following: a) conversion to another language, code or notation; b) reproduction in a different material form.

The above-disclosed subject matter is to be considered illustrative, and not restrictive, and the appended claims are intended to cover all such modifications, enhancements, and other embodiments, which fall within the true spirit and scope of the present disclosure. Thus, to the maximum extent allowed by law, the scope of the present embodiments are to be determined by the broadest permissible interpretation of the following claims and their equivalents, and shall not be restricted or limited by the foregoing detailed description. While various embodiments have been described, it will be apparent to those of ordinary skill in the art that many more embodiments and implementations are possible within the scope of the above detailed description. Accordingly, the embodiments are not to be restricted except in light of the attached claims and their equivalents.

The invention claimed is:

1. A call-for-service device comprising:

a plurality of touch targets coupled with a control circuit; and a light source coupled with the control circuit and responsive to selection of the touch targets as controlled by the control circuit, the control circuit associating a plurality of lighting patterns of the light source with respective touch targets, the lighting patterns including flashing and solid lighting patterns that signal to wait staff a plurality of service requests;

where the control circuit is programmable through an external connection to the call-for-service device to set the plurality of lighting patterns corresponding to the respective touch targets such that the lighting patterns are customizable for a plurality of applications.

2. The call-for-service device of claim 1, where the external connection comprises a wired connection or a wireless connection and the emissive light source comprises one or more selected from the group consisting of: a light emitting diode (LED), an electroluminescence coating, and a light bulb.

3. The call-for-service device of claim 1, where the control circuit comprises a micro-controller coupled with a printed circuit board (PCB), further comprising:

a selector switch coupled with the PCB that includes a plurality of switch positions, each switch position to control a separate lighting program, each lighting program including a set of lighting patterns, where the micro-controller is programmable to associate each lighting program with a different switch position of the selector switch; and a base containing the light source, the touch targets, the PCB, the micro-controller, and the selector switch.

4. The call-for-service device of claim 1, where the plurality of lighting patterns comprises a first color followed by a second color to indicate a passage of time, and the lighting patterns are turned off by receipt of an input signal from a switch coupled with the control circuit.

5. The call-for-service device of claim 1, where the plurality of lighting patterns comprises one or more solid colors in sequence with at least one flashing color to indicate a status of a service request.

6. The call-for-service device of claim 5, where the flashing color part of the lighting patterns is to indicate how long the service request has been pending.

7. The call-for-service device of claim 6, where the lighting patterns are turned off by selection of the touch target that was selected to initiate the lighting patterns.

8. A call-for-service device comprising:

a plurality of touch targets coupled with a control circuit;

a light source coupled with the control circuit and responsive to selection of the touch targets as controlled by the control circuit, the control circuit associating a plurality of lighting patterns of the light source with respective touch targets; and a selector switch including a plurality of switch positions, each switch position to control a separate lighting program, each lighting program including a set of lighting patterns corresponding to respective touch targets that signal to wait staff a plurality of service requests and statuses of the service requests;

where the control circuit is programmable to associate each lighting program with a different switch position of the selector switch, to program the service device for a plurality of applications associated with respective lighting programs.

9. The call-for-service device of claim 8, where the lighting patterns include flashing and solid colors displayed in a sequence to indicate a status of a service request, where the light source comprises one or more selected from the group consisting of: a light emitting diode (LED), an electroluminescence coating, and a light bulb.

10. The call-for-service device of claim 9, where the flashing color part of the sequence is to indicate how long the service request has been pending and is lit after the one or more solid colors are lit, where the control circuit comprises a micro-controller coupled with a printed circuit board (PCB).

11. A call-for-service device comprising:

a base including a light source and including a plurality of touch targets coupled with the light source, the light source responsive to selection of the touch targets by lighting up in a lighting pattern corresponding to each selected touch target; and a lens integrated within the base through which to project light from the light source onto a surface located near the base, to signal to wait staff a service request based on the light projected onto the surface.

12. The call-for-service device of claim 11, where the light source comprises a light emitting diode (LED) and the lens is positioned within a gap formed in a top portion of the base.

13. The call-for-service device of claim 11, where the light source comprises a light emitting diode (LED), further comprising:

a housing containing the lens that is pivotally attached to a top portion of the base, where the LED is located behind the lens inside of the housing.

14. The call-for-service device of claim 11, where the light source comprises a first light emitting diode (LED), further comprising:

a second LED coupled with the first LED such that the first and second LEDs are lit at the same time; and a substantially translucent shaft protruding from within a cavity in a top portion of the base, the cavity sized to receive a first end of the shaft, where the second LED is located at the first end of shaft and oriented to project light through the shaft.

15. The call-for-service device of claim 14, further comprising:

a printed circuit board (PCB), where the first and second LEDs are connected to the PCB; and a micro-controller coupled with the PCB that is programmable through an external connection to the PCB to set a plurality of lighting patterns corresponding to the respective touch targets, the micro-controller to control the lighting patterns of the first and second LEDs in response to selection of respective touch targets.

16. A call-for-service device comprising:

a light source;

a substantially translucent shaft;

a base defining a cavity in a top portion thereof, the cavity sized to receive a first end of the shaft in a first section of the cavity and sized to receive the light source in a second section of the cavity such that the light source and the first end of the shaft are closely adjacent; and a plurality of touch targets coupled with the light source and positioned within the base, the light source responsive to selection of the touch targets by lighting up in a lighting pattern corresponding to each selected touch target, where the shaft is lit by the light source according to the lighting pattern to signal a service request.

17. The call-for-service device of claim 16, where a second end of the shaft is formed into a geometric shape.

18. The call-for-service device of claim 16, where the shaft comprises a rectangular cross section, the first section of the cavity is rectangular and sized to receive the shaft, and the second section of the cavity is circular and sized to receive the light source, the light source comprising a light bulb or a light emitting diode (LED).

19. The call-for-service device of claim 18, further comprising:

a pair of locating pins positioned on opposing sides of the light bulb or LED to ensure the light bulb or LED is centered on the first end of the shaft.

20. The call-for-service device of claim 16, where the light source comprises a light emitting diode (LED) and the first end of the shaft and the LED contact each other.

21. The call-for-service device of claim 16, further comprising:

a placard for printing thereon an advertisement or identifier; and a substantially translucent clip holder attached to a second end of the shaft for holding the placard, where the light shines through the shaft and clip and onto the placard.

22. The call-for-service device of claim 16, further comprising:

a cover sized to cover the base, the cover including a pattern to indicate the locations of the touch targets and their respective signaling indications.

23. The call-for-service device of claim 16, where the light source comprises a light emitting diode (LED), further comprising:

a printed circuit board (PCB), where the LED is connected to the PCB; and a micro-controller coupled with the PCB that is programmable through an external connection to the PCB to set a plurality of lighting patterns corresponding to the respective touch targets, the micro-controller to control the lighting patterns of the LED in response to selection of respective touch targets.

24. The call-for-service device of claim 23, where the lighting patterns comprise one or more colors in sequence with at least one flashing color to indicate a period of time since the corresponding touch target was selected.

25. The call-for-service device of claim 24, where the lighting patterns are turned off by receipt of an input signal from an indicator coupled with the PCB, the indicator comprising a touch target corresponding to the touch target selected to initiate the lighting patterns.

* * * * *